US006830809B2

(12) United States Patent
Loecher et al.

(10) Patent No.: US 6,830,809 B2
(45) Date of Patent: Dec. 14, 2004

(54) YARNS, FIBRES AND FILAMENTS THAT CAN BE FIBRILLATED, METHOD AND DEVICE FOR THEIR PRODUCTION

(75) Inventors: Engelbert Loecher, Worms (DE); Helmut Leiner, Blieskastel (DE); Robert Groten, Sundhofen (FR); Georges Riboulet, Colmar (FR)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 10/473,308

(22) PCT Filed: Feb. 8, 2002

(86) PCT No.: PCT/EP02/01301

§ 371 (c)(1),
(2), (4) Date: Sep. 25, 2003

(87) PCT Pub. No.: WO02/077333

PCT Pub. Date: Oct. 3, 2002

(65) Prior Publication Data

US 2004/0104116 A1 Jun. 3, 2004

(30) Foreign Application Priority Data

Mar. 27, 2001 (DE) ..... 101 15 185

(51) Int. Cl.[7] ..... D01F 8/00

(52) U.S. Cl. ..... 428/370; 428/373; 428/374; 428/397

(58) Field of Search ..... 428/370, 373, 428/374, 397

(56) References Cited

U.S. PATENT DOCUMENTS

| | | | | |
|---|---|---|---|---|
| 4,370,114 | A | 1/1983 | Okamoto et al. | 425/131.5 |
| 5,562,930 | A | 10/1996 | Hills | 425/198 |
| 5,899,785 | A | 5/1999 | Groten et al. | 442/334 |

FOREIGN PATENT DOCUMENTS

| | | | |
|---|---|---|---|
| DE | 2936300 | 4/1981 | |
| EP | 0413688 | 6/1994 | D01D/4/00 |
| FR | 2647815 | 12/1990 | D01D/5/30 |
| JP | 56000317 | 1/1981 | D01F/8/04 |
| JP | 05239718 | 9/1993 | D01F/8/14 |
| JP | 07026454 | 1/1995 | |
| WO | 9716585 | 5/1997 | D01D/4/02 |

*Primary Examiner*—N. Edwards
(74) *Attorney, Agent, or Firm*—Davidson, Davidson & Kappel, LLC

(57) ABSTRACT

A splittable yarns, fiber or filaments and a method and device for their production. The yarns, fiber or filaments includes at least two elementary filaments of a first polymer A and each second elementary filament is sheathed with a second polymer B.

33 Claims, 5 Drawing Sheets

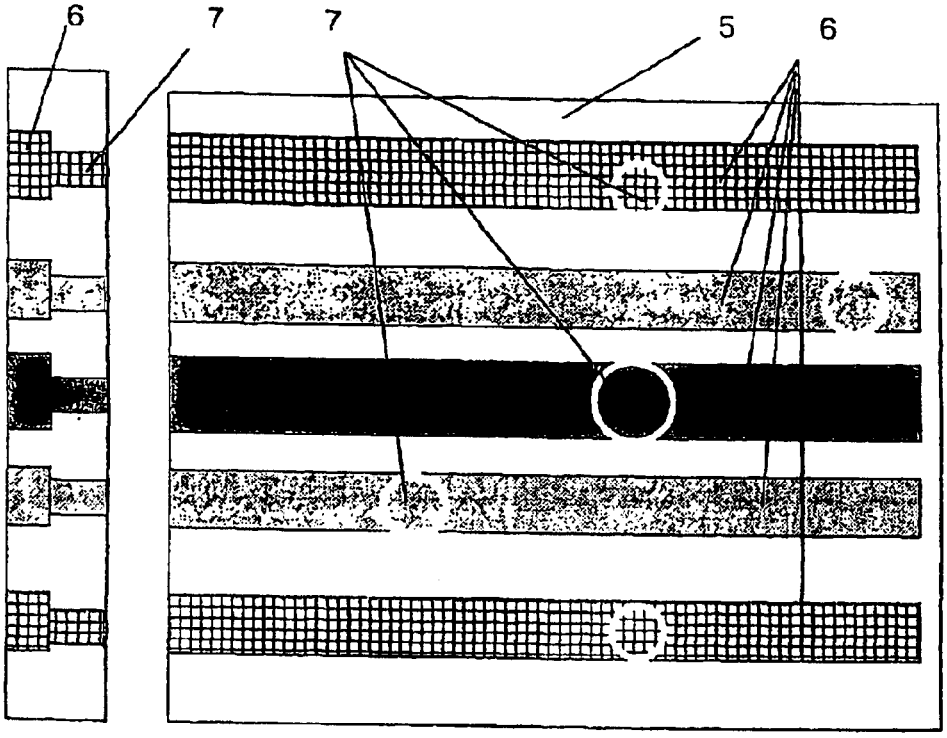
Fig. 11
Fig. 12
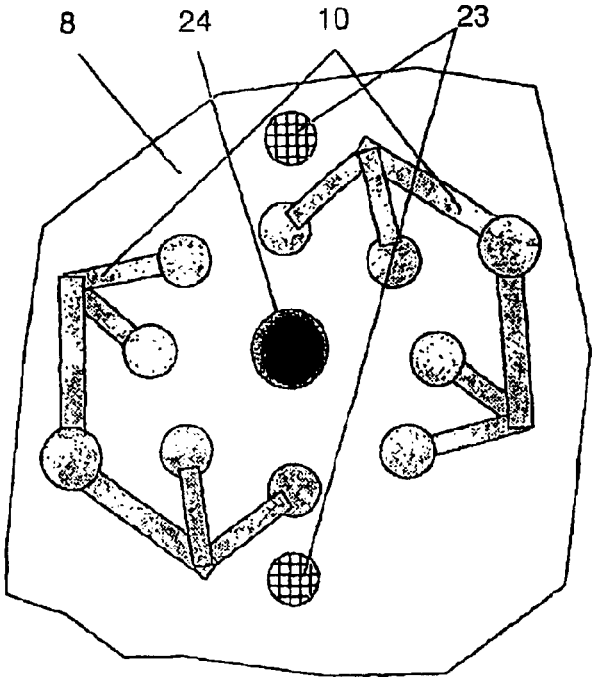
Fig. 13

YARNS, FIBRES AND FILAMENTS THAT CAN BE FIBRILLATED, METHOD AND DEVICE FOR THEIR PRODUCTION

BACKGROUND

The present invention relates to splittable fibers, yarns or filaments, a method and a device for production of same.

Japanese Patent JP 07/026,454 and U.S. Pat. No. 5,899,785 describe splittable fibers, yarns, or filaments composed of at least two types polymers that tend to mutual phase separation Polyamides and polyesters are preferred.

In addition, European Patent EU 413 688, U.S. Pat. No. 5,562,930 and French Patent FR 2,647,815 describe methods and devices for producing splittable fibers, yarns, or filaments by a melt-spinning operation using two mutually incompatible polymers. The individual polymer melt streams are passed through distribution plates within a spinning head, so that each fiber coming out of the spinning head is made up of a plurality of elementary fibers of the particular polymer, which are arranged in alternation as viewed in the cross section of the fiber.

In particular the use of nylon 6.6 as one of the polymers is associated with a high cost for the starting material. This starting material also necessitates drying of the raw material, causes an electrostatic charge buildup during the spinning operation, and tends to yellow under the influence of light and heat. To achieve a very good color fastness, splittable fibers, yarns, or filaments produced using these starting materials must be dyed in a second step. Therefore there is a need for greatly reducing the amount of a polymer component, in particular the nylon component in the splittable fibers, yarns or filaments. However, the weight ratio of the polymers to one another may be varied only in a ratio of 30:70 to 70:30 with the known methods of producing them, since otherwise no separate polymer segments are obtained which makes splitting into microfibers or microfilaments impossible. In the wake of increasing demands regarding the flexibility of the production process for splittable fibers, yarns or filaments, there is a demand for those which are easily manufactured from the standpoint of the percentage composition of the polymers used and the denier of the elementary fibers contained in them and which are easily handled with regard to the changes required in the device.

SUMMARY OF THE INVENTION

The present invention provides splittable fibers, yarns, or filaments composed of at least two elementary fibers of a polymer A, every second elementary fiber being at least partially sheathed with polymer B so that the surface of the splittable yarn, fiber or filament has alternating sections of polymers A and B. The splittable fibers, yarns, or filaments according to the present invention permit a reduction in the amount of polymer B to 5 wt % to 25 wt % and thus make it possible to manufacture a product having extensive polymer uniformity. This yields advantages with regard to the mechanical properties, the recyclability and reduction in cost of materials. The splittable fibers, yarns, or filaments according to the present invention are suitable in particular for producing textile knits, woven or nonwoven fabrics.

According to the present invention, this object is achieved by splittable fibers, yarns, or filaments composed of at least two elementary fibers of a polymer A, every second elementary fiber being at least partially sheathed with polymer B so that the surface of the splittable yarn, fiber or filament has alternating sections of polymers A and B. The splittable fibers, yarns, or filaments according to the present invention permit a reduction in the amount of polymer B to 5 wt % to 25 wt % and thus make it possible to manufacture a product having extensive polymer uniformity. This yields advantages with regard to the mechanical properties, the recyclability and reduction in cost of materials. The splittable fibers, yarns, or filaments according to the present invention are suitable in particular for producing textile knits, woven or nonwoven fabrics.

The remaining elementary fibers are preferably sheathed with a pigment-dyed mass of polymer A, thus yielding colorfast products which show only minor changes in mechanical properties in comparison with the undyed products, because only 1 wt % to 15 wt %, preferably 2 wt % to 12 wt % of the elementary fibers is used as dyed sheath component (master batch).

They preferably have a round, oval, flat, tubular, or cross-shaped cross section so that they can meet different requirements.

The method according to the present invention for producing the splittable fibers, yarns, or filaments is implemented in such a manner that polymers A and B are introduced in molten form into a spinning head, where they are distributed in groups of elementary fibers, every second elementary fiber being sheathed with polymer B, combined in spinnerets to form the splittable fibers, yarns, or filaments and then drawn. The remaining elementary fibers are preferably sheathed with a pigment-dyed mass of polymer A. Then the groups of elementary fibers are pressed through spinnerets having round, oval, rectangular, ring-segment-shaped or cross-shaped outlet openings. The splittable fibers, yarns, or filaments are drawn in a pneumatic drawing operation. As alternative methods, the known mechanical drawing operations such as godet roller drawing are possible.

The splittable fibers, yarns, or filaments are produced in the device according to the present invention by a melt-spinning process using at least two mutually incompatible polymers by introducing them into a spinning head having a modular design composed of a first distribution plate having alternating distribution channels and openings to a second distribution plate, the alternating distribution channels of the second distribution plate forming an angle of approximately 90° to the distribution channels of the first distribution plate which has openings which supply polymer to a third distribution plate and represent the connection between the second distribution plate and a first outlet plate for the elementary fibers, the third distribution plate having subdistribution channels which extend over its entire thickness and the ends of which correspond to the number of outlet openings for elementary fibers, and then there follows a fourth distribution plate in which the subdistribution channels likewise extend over its entire thickness and permit at least a partial sheath to be formed on every second elementary fiber; this is followed by a second outlet plate in which the outlet openings for the elementary fibers are configured in groups in which the distances between the adjacent outlet openings for polymer A and for polymer A sheathed with B are approximately the same size and each is connected to a plate having spinnerets out of which the polymers are discharged and drawn to form splittable fibers, yarns, or filaments by a downstream drawing device.

By replacing the distribution plates and/or the outlet plates, it is easily possible to vary the spinning head having a modular design according to the present invention with regard to the number, i.e., quantity, of elementary fibers contained in the splittable fibers, yarns or filaments. In particular, it is possible to produce a fiber, filament or yarn that is almost uniform with regard to the polymers and is nevertheless splittable because polymer B which is incompatible with polymer A and is necessary for this purpose only surrounds every second elementary fiber of polymer A as a separator sheath. Due to asymmetrical sheathing, i.e., an irregular wall thickness of the sheathing or incomplete sheathing, a tendency to crimping of the split filaments may also be produced.

In addition, the subdistribution channels extending over the total thickness of the distribution plate ensure a good throughput of the polymer through the spinning head and simplified cleaning.

The device according to the present invention is advantageously one in which a fifth distribution plate is situated between the fourth distribution plate and the second outlet plate, its subdistribution channels extending uniformly over its total thickness and allowing a sheath to be formed on the remaining elementary fibers, polymer C passing through bores in the third and fourth distribution plates and the first outlet plate to the fifth distribution plate.

Sheathing of the remaining elementary fibers with a spin-dyed mass of the polymer forming the core is preferred because the colorfastness of the products can be increased easily in this way without any significant negative effect on the mechanical properties of the fibers, filaments, or yarns due to the addition of the pigments.

Another advantageous embodiment of the present invention is based on the fact that the subdistribution channels of the third distribution plate for polymer A supply polymer to the outlet openings of the first outlet plate arranged in a circle beneath that, and polymer B passes through an opening configured centrally thereto through the third distribution plate and the first outlet plate to the fourth distribution plate and is brought to every second elementary fiber through the subdistribution channels.

The device in which the outlet openings for the elementary fibers in the groups of the outlet plate are arranged approximately in a circle is particularly preferred, one group including 6, 8, 12, 16, 24, 32, or 48 outlet openings. The denier of the elementary fibers may be varied by the number of elementary fibers in a group, which are combined to form a splittable yarn, fiber, or filament.

The device is preferably also one in which the groups of outlet openings for the elementary fibers are arranged approximately in concentric circles. The concentric circle arrangement ensures, first, a favorable oncoming flow of cooling air and, second, that all the splittable fibers, yarns, or filaments coming from a spinning head will be combined in a common drawing device.

The device is preferably also one in which the diameter of the outlet openings for the elementary fibers is in the range of 0.15 mm to 0.9 mm.

A device in which the outlet openings for the polymers have different diameters is particularly preferred. The ratio of the polymers in a splittable yarn, fiber, or filament may vary due to the different diameters for the outlet openings.

Also preferred is a device in which the distances between the groups of the outlet openings on the approximately concentric circles amount to 0.15 to 0.9 mm and the distances between the circles amount to 5 to 50 mm. The corresponding distances have proven advantageous with regard to utilization of area and the stability of the second distribution plates.

This device is advantageously characterized in that the ends of the subdistribution channels of the second distribution plate are forked in a V shape. A corresponding design of the subdistribution channels results in a very advantageous utilization of space without any hydrodynamic disadvantages.

The device according to the present invention is characterized in particular in that the first distribution plate, the second distribution plate, and the outlet plate are joined directly together and centered by bolts or screws passing through their edges without seals or sealing compounds. The connection according to the present invention of the first distribution plate to the second distribution plate and the outlet plate ensures a tight assembly of the modular spinning head without requiring seals or sealing compounds.

The third, fourth, and fifth distribution plates according to the present invention and the first and second outlet plates are made of metal plates 0.2 to 2.5 mm thick, preferably 0.5 to 1.5 mm thick.

The method according to the present invention for producing fibers, yarns, or filaments is characterized in that due to the use of the second distribution plate having subdistribution channels with 6, 8, 12, 16, 24, 32 or 48 outlet openings, the number of elementary fibers of the splittable fibers, yarns, or filaments is varied. Thus it is possible to produce splittable fibers, yarns, or filaments from the corresponding number of elementary fibers in a very economical manner only by replacing a component.

The method according to the present invention for producing splittable fibers, yarns, or filaments is preferably performed by varying the mass ratio of polymer A to B by replacing the outlet plate due to the fact that an outlet plate having different diameters of the outlet openings for the polymer is used. Thus it is possible to adjust the composition ratio of the splittable fibers, yarns, or filaments in a wide range. In addition due to the use of the fifth distribution plate it is possible to produce two elementary fibers having different sheaths. A dyed polymer sheath is preferably produced using the fifth distribution plate.

BRIEF DESCRIPTION OF THE DRAWING

The present invention is explained in greater detail below on the basis of three schematic illustrations, in which:

FIG. 11 shows a cross section through the second distribution plate;

FIG. 12 shows a partial detail of the second distribution plate having distribution channels for three different polymer flows;

FIG. 13 shows a partial detail of the third distribution plate having subdistribution channels for eight elementary fibers;

DETAILED DESCRIPTION

Figure 1:
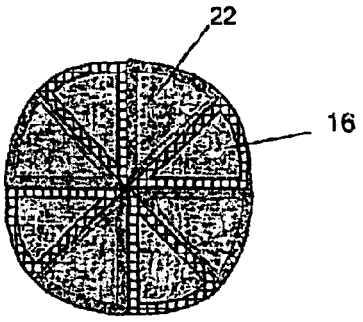
FIGS. 1, 2 show cross sections through fibers, yarns, or filaments produced with the help of the device according to the present invention.
Figure 2:
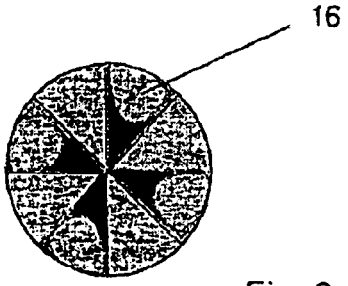

FIGS. 1 and 2 show cross sections through splittable fibers, yarns, or filaments produced using spinning head 1 according to the present invention, elementary fibers 16, 22 being made up essentially of polymer A. FIG. 1 shows symmetrically sheathed elementary fibers 16, 22, and FIG. 2 shows asymmetrically sheathed elementary fibers 16. Elementary fibers 22 in FIG. 1 are additionally sheathed with polymer C, i.e., polymer A spin-dyed with pigments. Polymers A, B and optionally C flow essentially vertically through spinning head 1.

Figure 3:
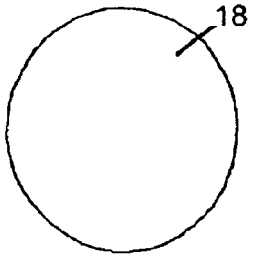
FIGS. 3 through 6 show spinneret shapes for the fibers, yarns or filaments.
Figure 4:
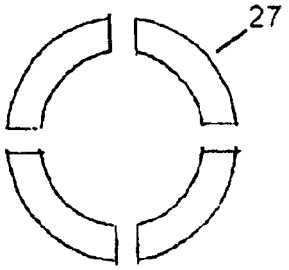
Figure 5:
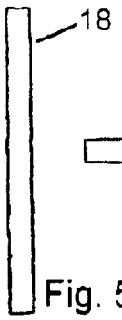
Figure 6:
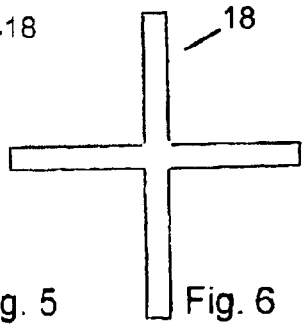
Figure 19:
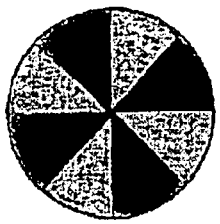
Fig. 19 Prior Art
FIGS. 19, 20 show cross sections through the fibers, yarns, or filaments according to the related art.
Figure 20:
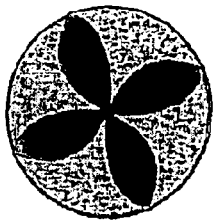
Fig. 20 Prior Art

FIGS. 3 through 6 show possible spinneret shapes 18. Splittable fibers, yarns, or filaments having a cross section like that shown in FIG. 3 are obtained with a spinneret 18 according to FIG. 3; splittable hollow yarns, fibers or filaments are obtained with an additional spinning plate 27 according to FIG. 4; splittable flat yarns, fibers or filaments are obtained with a spinneret 18 according to FIG. 5; and splittable tetralobal fibers, yams, or filaments are obtained with a spinneret 18 according to FIG. 6.

Figure 7:
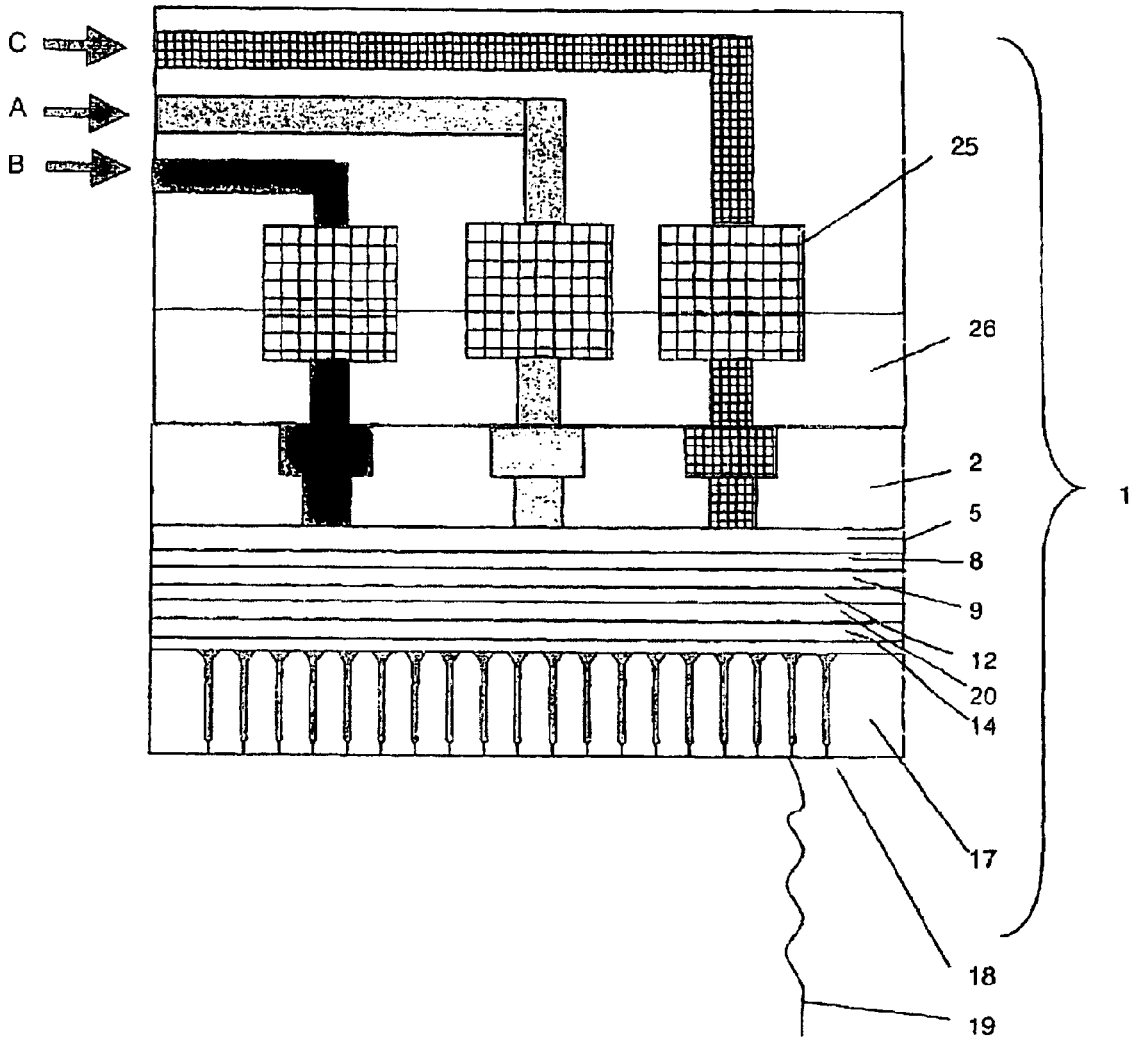
FIG. 7 schematically shows a section through a spinning head.
Figure 8:
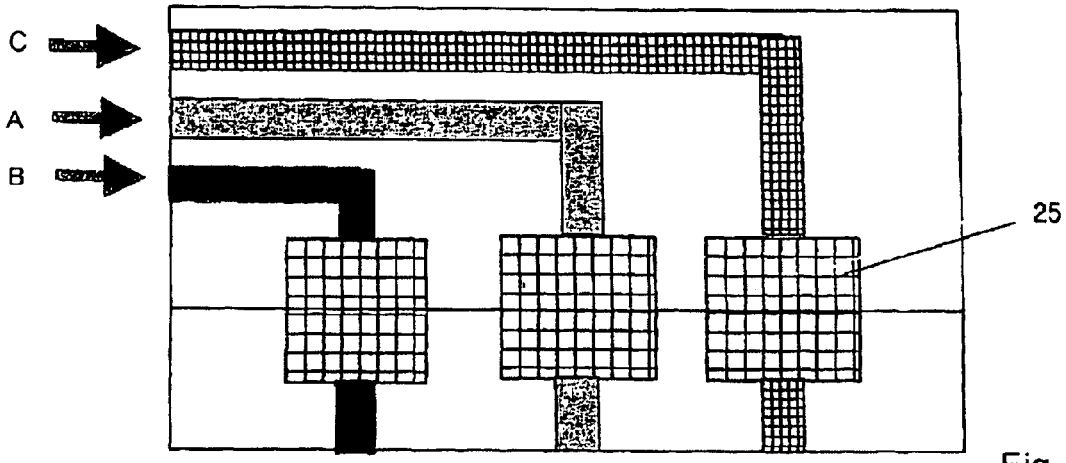
FIG. 8 shows a partial detail of the top part of a spinning head having the inlet line and the filtration device.
Figure 9:
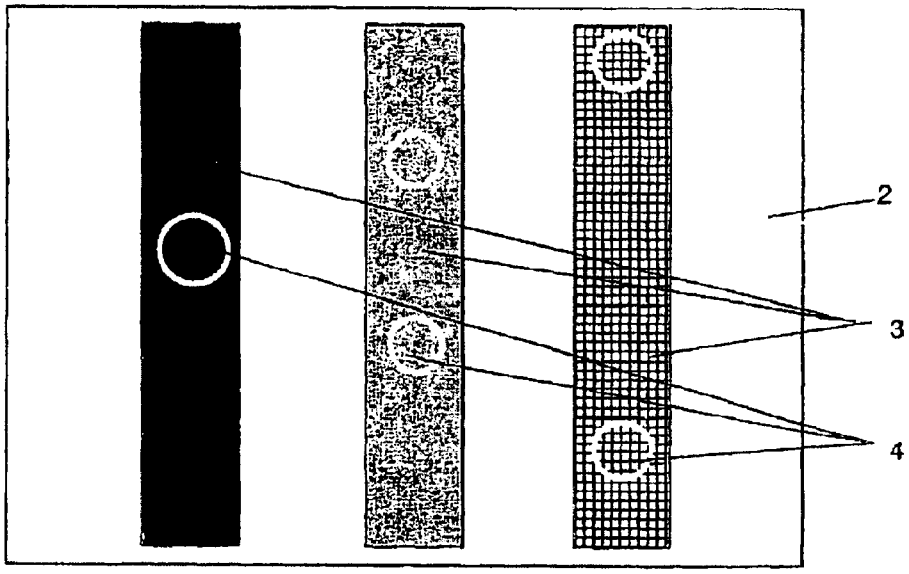
FIG. 9 shows a partial detail of the first distribution plate having distribution channels for three different polymer flows.
Figure 10:
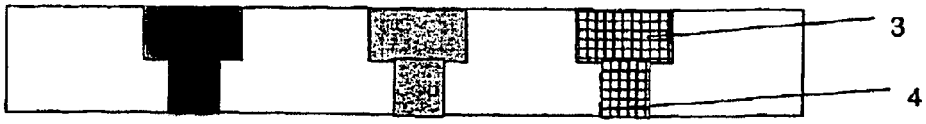
FIG. 10 shows a cross section through the first distribution plate.
Figure 14:
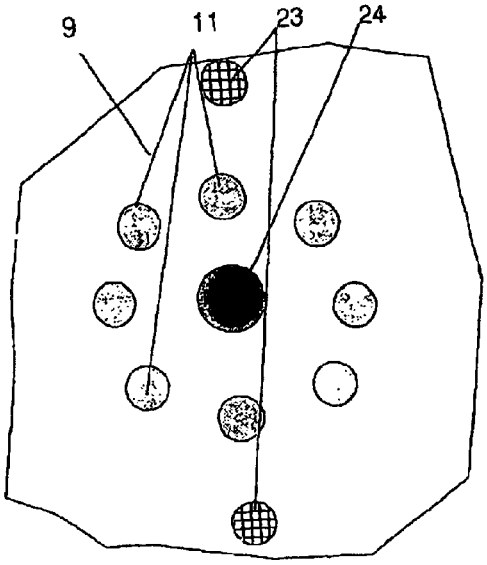
FIG. 14 shows a partial detail of the first outlet plate having a central passage for polymer B.
Figure 15:
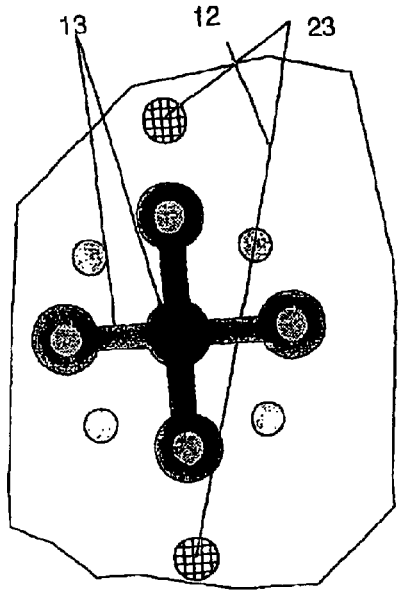
FIG. 15 shows a partial detail of the fourth distribution plate having subdistribution channels to produce a symmetrical sheath on every second elementary fiber.
Figure 16:
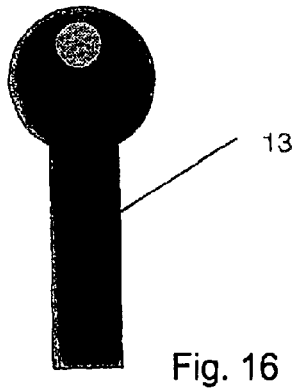
FIG. 16 shows a partial detail from FIG. 15 having a subdistribution channel to produce an asymmetrical sheath on every second elementary fiber.
Figure 17:
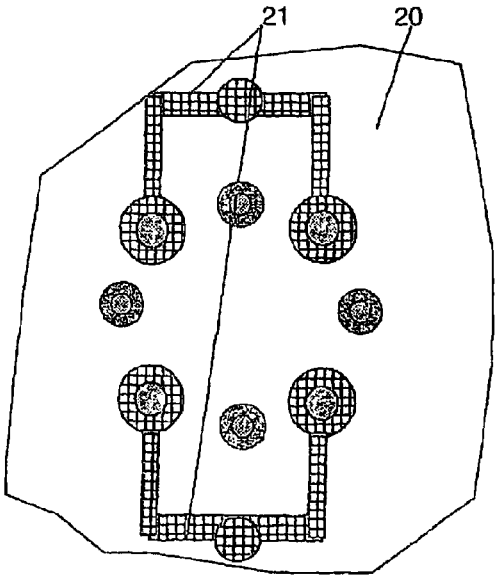
FIG. 17 shows a partial detail of the fifth distribution plate having subdistribution channels for the remaining elementary fibers.
Figure 18:
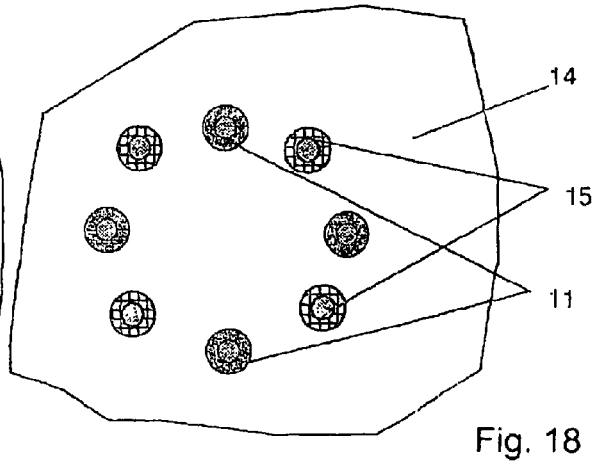
FIG. 18 shows a partial detail of the second outlet plate.

FIG. 7 schematically shows a section through a modular spinning head 1 having different inlet lines for polymers A, B and a spin-dyed polymer A which is labeled as C; they are filtered in chambers 25 and are directed by a guide plate 26 into first distribution plate 2 (FIG. 9) having distribution channels 3. Distribution plate 5 (FIGS. 11 12) and distribution channels 6 forming an angle of approximately 90° with distribution channels 3 receive polymers A and B and optionally C from distribution channels 3 through openings 4 above them. The polymers are directed to third distribution plate 8 (FIG. 13) through openings 7, polymer A being directed through subdistribution channels 10 to outlet openings 11 for the elementary fibers 16 of first outlet plate 9 (FIG. 14). A fourth distribution plate 12 (FIGS. 15, 16) is supplied with polymer B through a central opening 24. Polymer B is used to sheath every second elementary fiber 16. This is accomplished through subdistribution channels 13 of fourth distribution plate 12. There follows a second outlet plate 14 (FIG. 18), whose outlet openings 11, 15 for elementary fibers 16, 22 are configured in groups in which the distances between adjacent outlet openings 11, 15 for polymer A and B-sheathed polymer A are approximately equal in size and each is connected to a plate 17 having spinnerets 18 from which the polymers are discharged and drawn to yield splittable fibers, yarns, or filaments 19 using a downstream drawing device (not shown here). A fifth distribution plate 20 (FIG. 17) is provided for producing the sheath on the remaining elementary fibers 22 and is inserted between fourth distribution plate 12 and second outlet plate 14, and spin-dyed polymer C is brought onto elementary fibers 22, which are not yet sheathed, through subdistribution channels 21.

The present invention is explained in greater detail below on the basis of five examples.

EXAMPLE 1

With the help of the device according to the present invention, 12-segmented (12-pie) fibers having a titer of 2.5 dtex are produced using the device according to the present invention and are laid to form a web which is split into the elementary fibers and strengthened by a water jet treatment at a pressure of 200 bar water pressure and with the help of 6 water jet bars. Polymer A is an undyed polyethylene terephthalate (PET) and polymer B is a bulk-dyed nylon 6 (PA6), the weight ratio of polymer A to polymer B in the sheathed elementary fibers amounting to 80:20 wt %. Black pigments were used and a subsequent dying of the PET was performed. With a basis weight of 80 g/m$^2$ to 200 g/m$^2$ the resulting nonwoven is very suitable for applications in the automotive field due to its high colorfastness, its mechanical properties and virtual purity of the polymer, it is highly suitable for applications in automotive engineering.

EXAMPLE 2

With the help of the device according to the present invention, 18-segmented (18-pie) fibers having a titer of 2.5 dtex are produced and laid to form a web which is split and strengthened by a water jet treatment at a pressure of 300 bar water pressure and with the help of four water jet bars. Polymer A is a melt-dyed polyethylene terephthalate (PET) with 3 wt % dye masterbatch and polymer B is a melt-dyed nylon 6.6 (PA6.6) which is also melt-dyed with 3 wt % dye masterbatch, where the weight ratio of polymer A to polymer B in the unsheathed elementary fibers is 90:10 wt %. Rhenol blue is used as the dye. With a basis weight of 10 g/m$^2$ to 120 g/m$^2$, the resulting nonwoven is highly suitable for use as a wiping cloth because of its very high colorfastness and its mechanical properties.

EXAMPLE 3

With the help of the device according to the present invention, 12-segmented (12-pie) fibers having a titer of 2.5 dtex are produced and laid to form a web which is 98% split into the elementary fibers and strengthened with the help of 4 water jet beams by a water jet treatment at a pressure of 300 bar water pressure and then is smoothed by calendaring. Polymer A is a polyethylene terephthalate (PET) which is melt-dyed with 3 wt % dye masterbatch and polymer B is a nylon 6.6 (PA6.6) which is also melt-dyed with 3 wt % dye masterbatch, the weight ratio of polymer A to polymer B in the sheathed elementary fibers amounting to 90:10 wt %. The dye stuff used was Rhenol blue. The surface was then provided with a linen structure by an additional calendaring using a structured roller. With a basis weight of 80 g/m$^2$ to 250 g/m$^2$, the resulting nonwoven is highly suitable for production of work clothing because of its very high colorfastness and its mechanical properties.

EXAMPLE 4

With the help of the device according to the present invention, 16-segment (16 pie) fibers having a titer of 3.0 dtex are produced and laid to form a web which is 98% split into the elementary fibers and strengthened by a water jet treatment at a pressure of 200 bar water pressure and with the help of 4 water jet beams. An undyed polyethylene terephthalate (PET) is used as polymer A and an undyed nylon 6.6 (PA6.6) is used as polymer B, the weight ratio of polymer A to polymer B in the unsheathed elementary fibers amounting to 50:50 wt %. With a basis weight of 50 g/m$^2$ to 180 g/m$^2$, the resulting nonwoven is highly suitable for use as curtains or drapes because of its very great colorfastness and mechanical properties.

EXAMPLE 5

With the help of the device according to the present invention, 18-segmented (18 pie) fibers having a titer of 2.5 dtex are produced and laid to form a web which is 98% split into the elementary fibers and strengthened by a water jet treatment at a water pressure of 200 bar. Polymer A is undyed polyethylene terephthalate (PET) and polymer B is an undyed polypropylene (PP), where the weight ratio of polymer A to polymer B in the unsheathed elementary fibers amounts to 50:50 wt %. With a basis weight of 15 $g/m^2$ to 100 $g/m^2$ the resulting nonwoven is highly suitable for use as a filtration medium and for hygienic applications because of its very soft and fluffy consistency and its mechanical properties.

What is claimed is:

1. A splittable filament comprising:

at least two elementary fibers including a first polymer A, wherein every second elementary fiber of the at least two elementary fibers is at least partially sheathed with a second polymer B, so that an outer surface of the splittable filament has alternating sections of polymers A and B.

2. The splittable filament as recited in claim 1, wherein the polymers A and B are mutually incompatible.

3. The splittable filament as recited in claim 1, wherein the remaining elementary fibers that are not sheathed with the second polymer B are at least partially sheathed with a pigment-dyed compound of first polymer A.

4. The splittable filament as recited in claim 1, wherein the splittable filament has a cross-sectional shape that is round, oval, flat, tubular or cross-shaped.

5. A method of producing a splittable filament as recited in claim 1, the method comprising:

introducing first and second polymers A and B in molten form into a spinning head;

distributing the first and second polymers A and B into a group of a plurality of elementary fibers made of first polymer A, wherein every second elementary fiber of the group is at least partially sheathed with second polymer B;

combining the groups in a spinneret to form a splittable filament; and drawing the splittable filament from the spinneret.

6. The method as recited in claim 5, further comprising at least partially sheathing with a pigment-dyed compound of first polymer A every second elementary fiber of the group that is not sheathed with second polymer B.

7. The method as recited in claim 5, wherein the group of elementary fibers is pressed through a spinneret having one of a round, oval, rectangular, segmented ring-shaped and cross-shaped outlet openings.

8. The method as recited in claim 5, wherein the drawing is performed pneumatically.

9. The method as recited in claim 5, further comprising varying a number of elementary fibers of the group using a third distribution plate having a plurality of subdistribution channels having outlet openings.

10. The method as recited in claim 5, wherein the plurality of elementary fibers in the group includes 6, 8, 12, 16, 24, 32 or 48 elementary fibers.

11. The method as recited in claim 5 wherein the distributing is performed produced using a fifth distribution plate.

12. The method as recited in claim 6, wherein the at least partially sheathing with the pigment-dyed polymer is performed using a fifth distribution plate.

13. A device for producing a splittable filament as recited in claim 1 using a melt-spinning process having a spinning head for receiving mutually incompatible polymers A and B, the spinning head comprising:

a first distribution plate having a first A and a first B distribution channel and a first A and a first B opening;

a second distribution plate having a second A and a second B distribution channel communicating with the first A and the first B opening respectively, the second A and second B distribution channels being disposed at an angle of approximately 90 degrees with the first A and first B distribution channels and having respective second A and second B openings;

a third distribution plate having a third A and a third B distribution channel communicating with the second A and the second B outlet opening respectively and having a plurality of third A outlet openings and a third B outlet opening, the third distribution plate having a plurality of third A subdistribution channels each communicating with one of the third A outlet openings;

a first outlet plate having a plurality of first outlet A passages each communicating with one of the third A outlet openings and a first outlet B passage communicating with the third B outlet opening;

a fourth distribution plate having a plurality of fourth A distribution panels each communicating with the first A outlet passages and a fourth B distribution channels communicating with the first B outlet passages, the fourth distribution plate having a plurality of fourth A outlet openings, a plurality of fourth B outlet openings, and a plurality of fourth A subdistribution channels, each communicating with one of the fourth A outlet openings, the fourth distribution plate configured to provide a sheath of polymer B at least partially around an elementary fiber of polymer A passing through every second one of the plurality of fourth A outlet openings;

a second outlet plate having a plurality of second outlet passages for the passage of the polymers; and a spinneret plate having a spinneret communicating with the second outlet passages for receiving strands of polymer A and strands of polymer A sheathed with polymer B, the strands being drawn from the spinneret so as to form the splittable filament.

14. The device as recited in claim 13, further comprising a drawing device disposed downstream of the spinning head for the drawing the strands of polymers from the spinneret.

15. The device as recited in claim 13, wherein adjacent second outlet passages are spaced approximately equally from each other.

16. The device as recited in claim 13, wherein the third A subdistribution channels extend over an entire thickness of the third distribution plate.

17. The device as recited in claim 13, wherein the fourth B subdistribution channels extend over an entire thickness of the fourth distribution plate.

18. The device as recited in claim 13, wherein each of the plurality of fourth B outlet openings at least partially intersects one of the plurality of fourth A outlet openings.

19. The device as recited in claim 18, wherein every second one of the plurality of fourth A outlet openings at least partially intersects with one of the plurality of fourth B outlet openings.

20. The device as recited in claim 13, further comprising a fifth distribution plate disposed between the fourth distribution plate and the second outlet plate, and wherein the third and fourth distribution plates and the first outlet plate include a bore for passing a polymer C to the fifth distribution plate, the fifth distribution plate including fifth A passages for receiving unsheathed strands of polymer A and having a plurality of fifth subdistribution channels configured to provide a sheath of polymer C at least partially around each unsheathed polymer A strand passing through the fifth A passages.

21. The device as recited in claim 20, wherein polymer C includes a pigment-dyed polymer A.

22. The device as recited in claim 13, wherein the plurality first outlet A passages are arranged approximately in a circular pattern and the first outlet B passage is arranged centrally with respect to the circular pattern.

23. The device as recited in claim 13, wherein the plurality of second outlet passages are arranged approximately in a circular pattern.

24. The device as recited in claim 13, wherein the plurality of second outlet passages includes 6, 8, 12, 16, 24, 32, or 48 outlet passages.

25. The device as recited in claim 13, wherein the plurality of second outlet passages are arranged approximately in a pattern of concentric circles.

26. The device as recited in claim 13, wherein each of the plurality of second outlet passages have a diameter in the range of 0.15 mm to 0.9 mm.

27. The device as recited in claim 13, wherein the second outlet passages openings have different diameters.

28. The device as recited in claim 23, wherein each of the first, second, third, and fourth distribution plates and the first outlet plate include a variety of additional passages for forming a second for producing a second splittable filament, and wherein the second outlet plate includes a plurality of additional second outlet passages arranged approximately in a second circular pattern, a distance between the circular pattern and the second circular pattern being from 5 to 50 mm.

29. The device as recited in claim 13, wherein the third A subdistribution channels are joined in a V-shaped fork.

30. The device as recited in claim 13, wherein the first, second, third and fourth distribution plates, the first and second outlet plates, and the spinneret plate are interconnected directly by bolts or screws.

31. The device as recited in claim 13, wherein the first, second, third and fourth distribution plates, the first and second outlet plates are metal plates having a thickness of 0.2 to 2.5 mm.

32. The splittable filament as recited in claim 1, wherein the splittable filament is part of a yarn.

33. The splittable filament as recited in claim 1, wherein the splittable filament is a fiber.

* * * * *